United States Patent [19]

Owens

[11] 4,199,847

[45] Apr. 29, 1980

[54] WELL RISER SUPPORT HAVING ELASTOMERIC BEARINGS

[75] Inventor: James H. Owens, Houston, Tex.

[73] Assignee: Armco Inc., Middletown, Ohio

[21] Appl. No.: 7,049

[22] Filed: Jan. 29, 1979

[51] Int. Cl.[2] ..... A44B 21/00

[52] U.S. Cl. ..... 24/249 DP

[58] Field of Search ..... 24/249; 175/121; 248/632, 634; 14/16.1; 267/141.1

[56] References Cited

U.S. PATENT DOCUMENTS

| | | | |
|---|---|---|---|
| 1,314,960 | 9/1919 | Headrick | 24/249 DP |
| 1,755,986 | 4/1930 | Goetz | 24/249 DP |
| 1,807,286 | 5/1931 | Goetz | 24/249 DP |
| 2,162,714 | 6/1939 | Hamblin | 267/141.1 |
| 2,560,627 | 7/1951 | Boschi | 267/141.1 X |
| 2,655,005 | 10/1953 | Kinneman | 267/141.1 X |
| 3,984,990 | 10/1976 | Jones | 166/350 X |
| 4,039,176 | 8/1977 | Jansen | 267/125 |

*Primary Examiner*—Nile C. Byers, Jr.
*Attorney, Agent, or Firm*—Frost & Jacobs

[57] ABSTRACT

A well riser support for supporting and guiding an assembly of well riser pipe through a rotary table to facilitate coupling or uncoupling joints of riser pipe to the riser assembly. The support includes a spider assembly containing a plurality of hydraulically actuated dogs for supporting the riser and a plurality of resilient bearings supporting the spider assembly. Each bearing is configured to absorb and distribute loads applied parallel to and transversely of the riser axis, and comprises alternating layers of elastomeric and non-elastomeric materials with the compression axis of the bearing being inclined with respect to the riser axis.

16 Claims, 9 Drawing Figures

WELL RISER SUPPORT HAVING ELASTOMERIC BEARINGS

BRIEF SUMMARY OF THE INVENTION

In the drilling of oil and gas wells, particularly when the operation takes place in deep water, the well riser carrying a blowout preventer and possibly choke and kill lines is installed through a rotary table with the aid of a temporary riser support. The rotary table is utilized to rotate the drill pipe during drilling operations. The riser support temporarily supports the riser while a subsequent riser joint or section is being connected.

In general, such a riser is made up of a plurality of joints of riser pipe coupled by means of flanged collars and is assembled by supporting the uppermost joint of the riser from the rotary table affixed to a floating platform or vessel, in the case of a marine drilling operation. In many situations, a riser support temporarily positioned on the rotary table contains a plurality of dogs which may be opened to permit the riser to be lowered and thereafter brought into contact with the tapered portion of the tapered portion of the riser connector flange to support the assembled riser joints while a subsequent riser joint is being bolted or otherwise secured to the riser.

Generally, raising and lowering of the riser is carried out smoothly so that minimal forces are transmitted to the riser support and rotary table. However, in some situations, depending upon the skill of the driller, or motion of the vessel supporting the rotary table, the drilling riser may be dropped suddenly, producing significant impact forces on the riser support and rotary table. In operations in relatively deep water where the riser and attached blowout preventer may exceed one hundred tons in weight, these impact forces may severely damage the riser, rotary table or supporting vessel.

In addition, in marine operations, relative motion between the vessel-supported rotary table and the drilling riser can produce substantial lateral movements at the riser support, which can lead to structure fatigue and failure. Hence, it has been found desirable to maintain a relatively constant load on the riser and riser support despite vessel motion.

Hydraulic shock absorbers capable of absorbing shocks due to deceleration forces caused by relative vessel movement or landing of a marine riser on a riser support spider resting on a rotary table have been proposed in U.S. Pat. No. 3,984,990, issued Oct. 12, 1976, to Howard W. Jones for "Support Means for a Well Riser or the Like," and in U.S. Pat. No. 4,039,176, issued Aug. 2, 1977, to Barton B. Jansen, Jr., for "Marine Riser Spider Shock Absorber Apparatus." Such mechanisms, however, are relatively complex mechanically and require significant periodic maintenance and inspection to insure full operability.

The well riser support of the present invention, on the other hand, provides a simple maintenance-free passive means for absorbing shocks due to impact forces of lowered marine risers and relative movement between the riser and the accompanying vessel.

In general, the well riser support comprises an annular bearing ring secured to the uppermost surface of the rotary table and containing a central opening dimensioned to accept the well riser pipe. The uppermost surface of the bearing ring supports a plurality of circumferentially spaced resilient bearings which in turn support the spider assembly. Each resilient bearing comprises a stack of resilient wafer-like pads separated by metallic spacers. The longitudinal axis of each bearing slopes upwardly and inwardly toward the central opening contained in the bearing ring and spider assembly, thereby enabling the bearings to absorb forces exerted parallel to and transversely of the riser.

The spider assembly contains four circumferentially spaced hydraulically operated gimbaled support columns or dogs, the innermost ends of which bear against the outer surface of the riser joint connector to hold the riser joint securely in position. As will be explained in more detail hereinafter, the dogs may be pivoted outwardly to permit the riser and attached coupling flanges and choke and kill lines to be lowered through the riser support and rotary table. The dogs may then be pivoted inwardly. The outer surface of the riser joint connector would then rest on the upper surface of the dogs to hold the riser securely in position while a subsequent joint is being coupled to the riser. Sudden shocks or off-center loads may thus be distributed evenly to the four dogs by means of the resilient bearings to eliminate damaging impact forces to the riser, rotary table or supporting vessel.

BRIEF DESCRIPTION OF THE DRAWINGS

FIG. 9 is an enlarged cross sectional view taken along section line 9—9 of FIG. 6.

DETAILED DESCRIPTION

Figure 1:
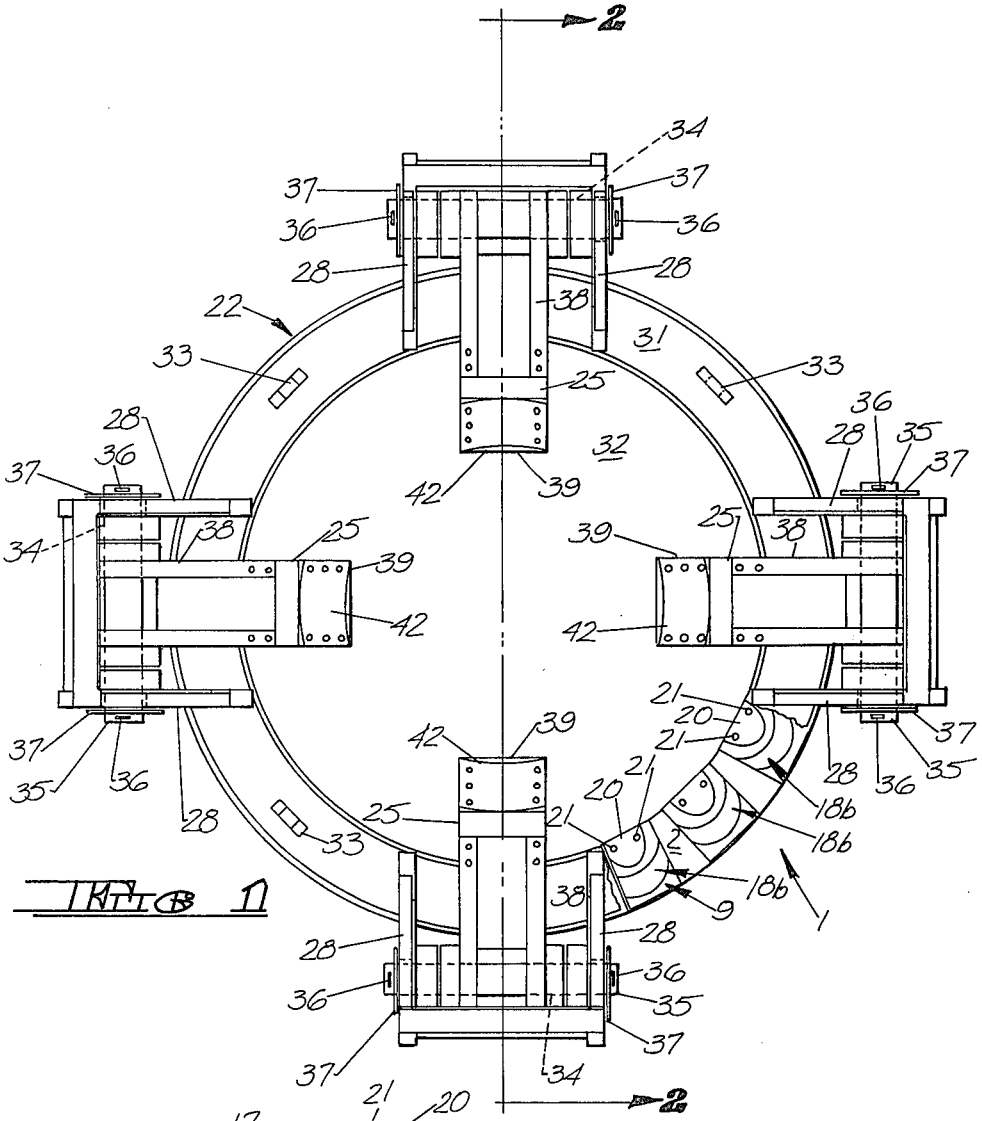
FIG. 1 is a plan view of the well riser support of the present invention partially cut away to show the position of the elastomeric bearings.
Figure 4:
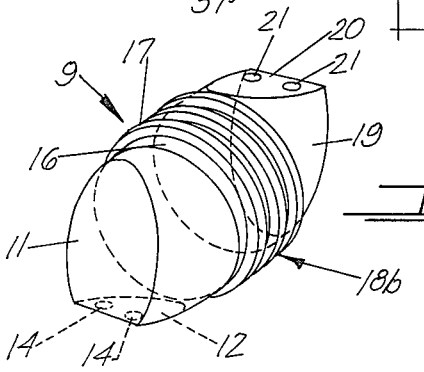
FIG. 4 is an enlarged perspective view of a single elastomeric bearing.
Figure 2:
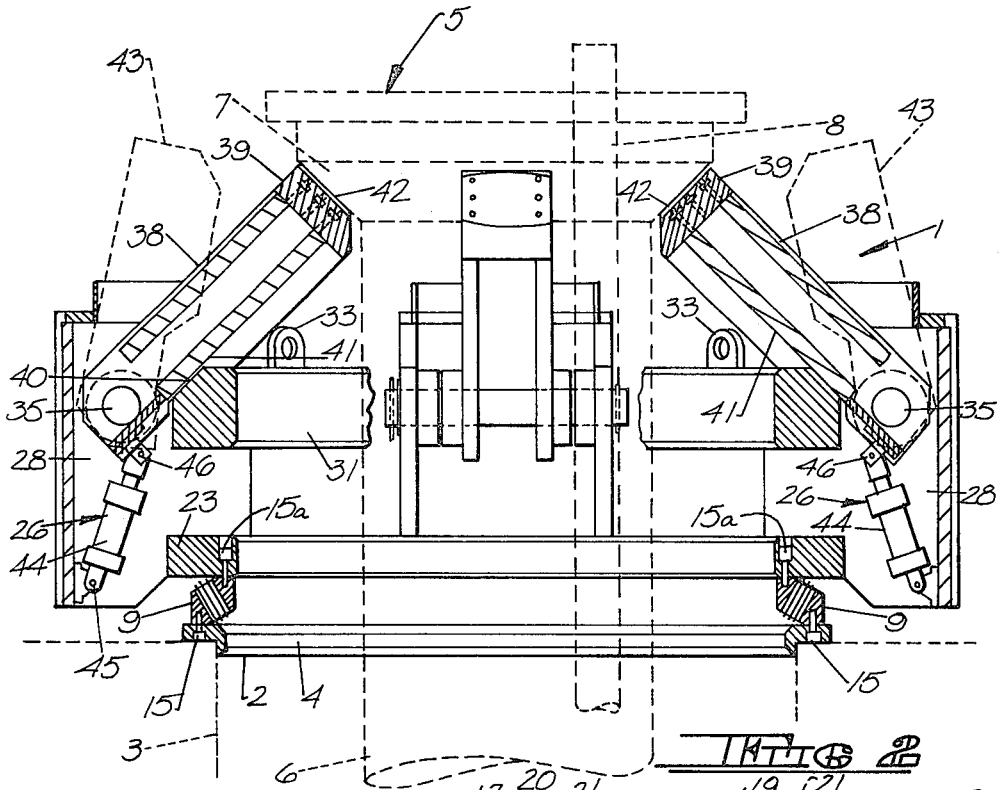
FIG. 2 is a fragmentary section view taken along section line 2—2 of FIG. 1 including the riser joint connector and choke and kill lines.
Figure 3:
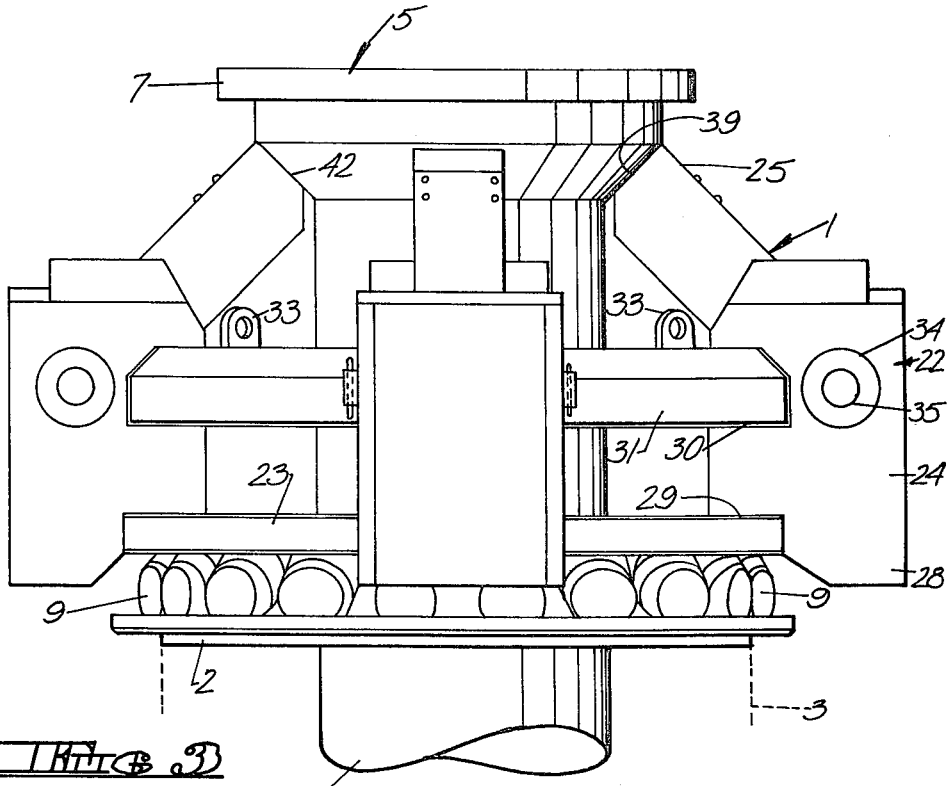
FIG. 3 is a side elevation view of the riser support including the riser joint connector.
Figure 4:
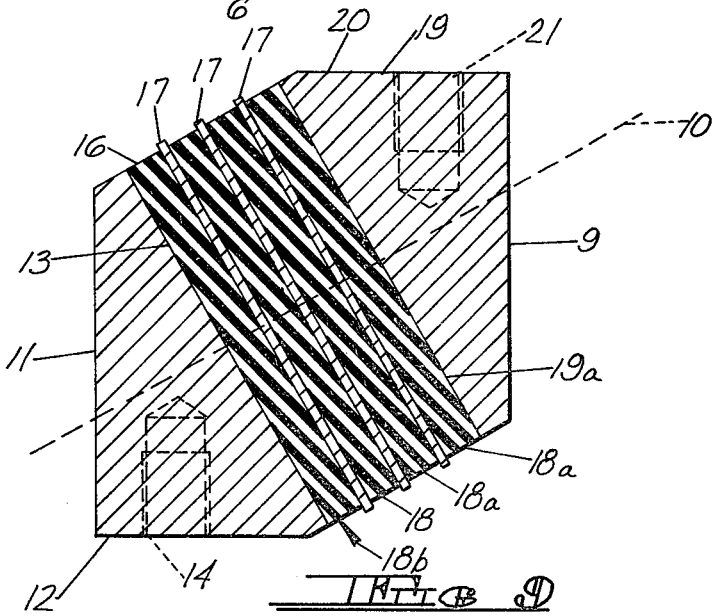

As is best shown in FIG. 1–FIG. 3, the well riser support, shown generally at 1, comprises an annular plate-like bearing ring 2 having a planar lower surface adapted to rest upon and be supported by the upper surface of the rotary table shown diagrmatically at 3. Bearing ring 2 contains a central opening 4 dimensioned to easily pass the drilling riser assembly shown generally at 5.

As is well known in the art, drilling riser assembly 5 comprises a plurality of riser joints or sections 6 interconnected by a flanged connector 7. Drilling riser assembly 5 may also be provided with suitable choke and kill lines as required, such as those illustrated at 8. The lowermost surface of flange connector 7 rests upon the support cradles of the spider assemply dogs as will be described in more detail hereinafter.

The uppermost planar surface of bearing ring 2 supports a plurality of circumferentially spaced resilient or elastomeric bearings, one of which is illustrated at 9. As shown in FIG. 1, well riser support 1 contains twenty equally spaced elastomeric bearings 9. However, it will be understood that any number of equally or unequally spaced bearings 9 may be used as required in particular situations.

Figure 5:
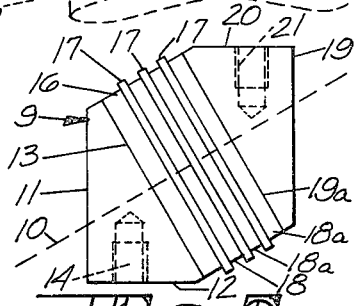
FIG. 5 is an enlarged side elevation view of a single elastomeric bearing.
Figure 6:
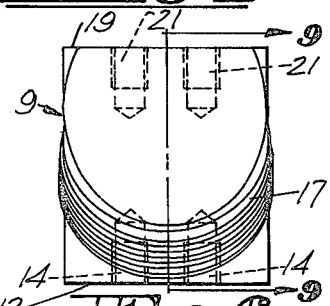
FIG. 6 is an end view of the bearing of FIG. 5.
Figure 8:
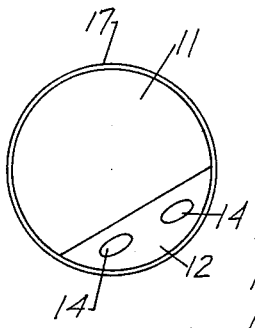
FIG. 8 is an auxiliary view taken along the compression axis 10 of FIG. 5.
Figure 7:
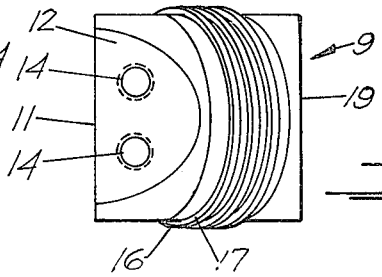
FIG. 7 is a bottom view of the bearing of FIG. 5.

As is shown in FIG. 4–FIG. 9, each elastomeric bearing 9 comprises a multiple layer oblique cylindrical structure. The compression axis illustrated by dashed line 10 in FIG. 5 is inclined upwardly and inwardly with respect to the longitudinal axis of drilling riser assembly 5 as is best shown in FIG. 2 in order to permit the bearing to absorb and distribute forces produced in directions parallel to and transversely of the longitudinal axis of the drilling riser assembly 5. The lowermost bearing ring abutting layer or bearing segment 11 of elastomeric bearing 9 is of substantially wedge-like cross section and contains a lower planar bearing ring abutting surface 12, and an upper non-parallel planar surface 13 substantially normal to the compression axis 10 of bearing 9. Surface 13 is substantially circular when viewed along compression axis 10. Lowermost surface 12 of bearing segment 11 also contains threaded apertures 14 normal to surface 12 for securing the bearing 9 by means of threaded fasteners 15 or the like to bearing ring 2. Bearing segment 11 may be constructed of any suitable material such as steel, aluminum or the like of sufficient strength such that bearing 9 can be adequately secured to bearing ring 2.

Overlying bearing segment 11 and bonded to bearing segment surface 13 by vulcanizing or the like is circular wafer-like resilient packing member 16 of substantially the same diameter as adjoining surface 13. Packing member 16 may be constructed of any elastomeric material such as natural rubber, Hycar® rubber, or the like. The hardness of the material chosen for packing member 16 will generally be on the order of 80–90 Shore durometer scale A, depending on the actual load to be supported by bearing 9.

One or more circular plate-like shims of slightly larger diameter than the packing members, one of which is shown at 17, is provided overlying packing member 16 in order to increase the actual bearing load which packing member 16 can support. The number of shims utilized, and the relative thickness of the elastomeric will depend on the shear and compression moduli of the material used for the packing member.

A second round packing member 18, substantially identical to packing member 16 overlies shim 17. Further packing members 18*a* may be used, each being separated from an adjacent packing member by a suitable shim 17. As best shown in FIG. 9, the exemplary elastomeric bearing 9 utilizes four packing members and three shims to form the complete packing member and shim assembly 18*b*. However, any number of bonded shims and packing members may be used depending on the specific application.

The packing member and shim assembly 18*b* supports a second bearing segment 19 substantially identical to bearing segment 11. Bearing segment 19 contains a substantially planar surface 19*a* abutting the uppermost packing member 18*a*, surface 19*a* appearing substantially circular when viewed along compression axis 10. Bearing segment 19 further contains a planar uppermost surface 20 adapted to abut the lowermost surface of the spider assembly of the well riser support 1 as will be described in more detail. Surface 20 contains threaded apertures 21 which can be used to secure the bearing to the underside of the spider assembly, such as by threaded fasteners 15*a*. It will be understood that the packing members may be bonded to shims 17 and bearing segment 19 by vulcanizing or the like.

Spider assembly 22 comprises an annular lower ring 23 which supports housing assembly 24. Housing assembly 24 includes a plurality of circumferentially spaced rotatable dogs one of which is shown at 25, and the associated dog actuating mechanism shown generally at 26 in FIG. 2. The purpose of spider assembly 22 is to temporarily secure the riser assembly in position while additional riser joints are being coupled or uncoupled.

Lower plate 23 rests on the upper surfaces 20 of the elastomeric bearings 9 and is attached thereto by threaded fasteners, one of which is shown at 15*a* which threadedly engage apertures 21 in each bearing 9. Lower ring 23 contains a central opening of sufficient size to easily pass the riser assembly 5 as it is raised or lowered.

Housing assembly 24 comprises four equally spaced support housings 28 which rotatably support dogs 25. The lowermost edge of each support housing 28 contains a notched portion 29 which rests upon and is supported by the uppermost surface of lower ring 23. A notched portion 30 is provided on the innermost edge of the support housings 28 and is spaced from lower ring 23 to provide a resting surface for annular tension ring 31 which serves to prevent outward movement of support housings 28 and provide rigidity to the structure. The tension ring 31 contains a central opening 32 coaxial with the openings in bearing ring 2 and lower ring 23, and is dimensioned to easily pass riser assembly 5 as it is raised and lowered. The upper surface of tension ring 31 may also be provided with a plurality of spaced upwardly standing lifting lugs 33 by which the entire well riser support 1 may be moved into or out of position by a lifting mechanism (not shown). Each support housing 28 is provided with coaxial bearing apertures 34 which rotatably receive a cylindrical support shaft 35. Axial movement of support shaft 35 is prevented by cotter pins 36 which pass through cooperating bores in the ends of shaft 35, and retaining washers 37 positioned between cotter pins 36 and the outermost bearing surfaces of support housings 28.

Dogs 25 comprise a support arm weldment 38, one end of which is rotatably secured to shaft 35, and a support cradle 39 affixed to the outermost end of support arm 38 and configured to rest against and support the flanged connector 7 of riser assembly 5 as will be explained in more detail hereinafter. Support cradle 39 may be constructed of a resilient material to provide further cushioning for flanged connector 7 of assembly 5.

As can best be seen in the sectioned view of FIG. 2, the outer edge of tension ring 31 contains an upwardly and outwardly facing chamfer 40 which bears against and supports the downwardly facing surface 41 of dogs 25 to limit the travel of the dogs as they are rotated inwardly to the position shown in FIG. 2. In this position, the curved surface 42 formed in the innermost face of cradle 39 bears against and supports the lower surface of flanged connector 7 to support the riser assembly 5 while riser joints are being coupled or uncoupled.

When the coupling or uncoupling operation has been completed, the riser assembly 5 is lifted slightly by means of a lifting mechanism (not shown) to clear surfaces 42 of dogs 25. Dogs 25 may then be pivoted upwardly and outwardly to the position illustrated by dashed line 43 in FIG. 2 thus bringing the cradle 39 out of supporting contact with flanged connector 7 so that the riser assembly 5 may be lowered or raised through the rotary table. Pivoting of dogs 25 between the fully extended position and the fully retracted position is facilitated by dog actuating mechanisms 26, each of which comprises a hydraulically operated cylinder 44 having one end pivotally attached to the lower portion of housing assembly 24 as at 45, and an upper end pivotally attached to the lowermost edge of dog 25 as at 46 by a clevis pin or the like. Thus when hydraulic cylinder 44 is in the fully retracted position as shown by solid lines in FIG. 2, dog 25 will assume the fully retracted position shown. When hydraulic cylinder 44 is activated so that the cylinder moves upwardly bearing against the lower edge of dog 25, the dog will be pivoted upwardly and outwardly to the position shown by dashed line 43.

The construction of the riser support permits the riser to remain substantially stationary when the supporting deck moves as a result of wind or wave motion, and tends to maintain approximately equal support on flanged connector 7 by supporting dogs 25.

It will be observed that the construction and positioning of elastomeric bearings 9 permit the bearings not only to deflect in a direction parallel to the axis of the drilling riser in order to absorb sudden load forces that might result from the relative motion of the riser and drilling causing the riser to be dropped against the dogs 25, but also to permit bearings 9 to deflect in a sideways direction transverse to the axis of the drilling riser to absorb forces generated by sideway movements of the drilling riser 5 as might be experienced in drilling operations conducted from a floating or semi-submersible drilling platform.

It has been found that the specific angle formed between the compression axis 10 of bearing 9 and surfaces 12 or 20 thereof will depend in part on the shear and compression moduli of the particular elastomeric material used for the packing layers 16 and 18, which in turn result from the shear and normal load forces expected in a particular drilling operation. For purposes of an exemplary showing, for packing materials having a hardness in the range of 80–90 Shore durometer scale A, the angle required between the compression axis 10 of bearing 9 and the surfaces 12 and 20 will be approximately 25°–35°.

It will be understood that various changes in the details, materials, steps and arrangements of parts which have been herein described and illustrated in order to explain the nature of the invention may be made by those skilled in the art within the principle and scope of the invention as expressed in the appended claims.

The embodiments of the invention in which an exclusive property or privilege is claimed are as follows:

1. A well riser support for supporting and guiding a riser comprising a plurality of riser joints connected by riser connectors through a rotary table containing a central bore dimensioned to pass the riser to facilitate coupling or uncoupling joints of riser pipe, said riser support comprising an annular bearing ring configured to rest upon and be supported by the rotary table and having a central opening substantially coaxial with the rotary table bore and dimensiond to pass the riser as it is being raised or lowered therethrough, a plurality of resilient bearings circumferentially spaced around the upper surface of said bearing ring, each of said bearings being configured to absorb and distribute loads applied parallel to and transversely of the riser, and a substantially ring-like spider assembly resting upon and supported by said bearings, said spider assembly having a central bore therein substantially coaxial with said bearing ring bore and dimensioned to pass the riser as it is being raised or lowered therethrough, said spider assembly including a plurality of circumferentially spaced rotatable dogs, each of said dogs being rotatable between a retracted position wherein said dog contacts the outer surface of said riser connector to support the riser while said joints are being coupled or uncoupled thereto, and an extended position wherein said dogs are brought out of contact with the riser connector such that the riser may be raised or lowered free of said dogs, said spider assembly further including means to rotate said dogs between said retracted and extended positions.

2. The well riser support according to claim 1 wherein the compression axis of said bearing is inclined with respect to the longitudinal axis of the riser.

3. The well riser support according to claim 2 wherein said compression axis inclines upwardly and inwardly toward the longitudinal axis of the riser.

4. The well riser support according to claim 1 wherein said bearing is constructed of an elastomeric material.

5. The well riser support according to claim 1 wherein the joint connector engaging end of said dog comprises a resilient material.

6. The well riser support according to claim 1 wherein said bearing comprises alternating layers of elastomeric and non-elastomeric materials.

7. The well riser support according to claim 6 wherein said elastomeric material has a stiffness of about 80–90 Shore durometer scale A and the compression axis of said bearing inclines inwardly and upwardly toward the longitudinal axis of the riser at an angle of about 25°–35°.

8. The well riser support according to claim 1 wherein said dog rotating means comprises a hydraulically operated member connected between one end of said dog and said spider assembly.

9. A resilient bearing for use with a well riser support configured to support and guide an assembly of riser pipe to facilitate coupling or uncoupling joints of riser pipe to the riser assembly, said bearing acting to support the riser support on a rotary table to absorb and distribute loads applied parallel to and transversely of the axis of the riser, said bearing comprising a substantially wedge-shaped lower bearing segment having a lower planar surface configured to support said riser support on the rotary table, said segment having an upper surface inclined with respect to and intersecting said lower surface; a wafer-like packing layer of elastomeric material having substantially parallel plane surfaces, the lowermost of said surfaces abutting said upper surface of said lower segment; and an upper bearing segment having a lower substantially plane surface abutting the uppermost surface of said packing layer and a substantially planar upper surface inclined with respect to said lower surface of said upper segment, said upper surface of said upper bearing segment being configured to support the riser support and containing means for attaching said upper segment to the riser support, said lower surface of said lower bearing segment and said upper surface of said upper bearing segment being substantially parallel such that the compression axis of said bearing forms angles of less than 90° with respect to said last said lower and upper surfaces.

10. The bearing according to claim 9 wherein said compression axis forms angles of about 25°–35° with respect to said lower and upper surfaces.

11. The bearing according to claim 9 wherein said bearing comprises two or more packing layers and a non-elastomeric plate-like shim separating said layers from each other.

12. The bearing according to claim 11 wherein said bearing segment and said shim are bonded to said packing layers.

13. The bearing according to claim 9 wherein said packing layer comprises an elastomeric material having a stiffness of about 85–90 Shore durometer scale A.

14. The bearing according to claim 9 wherein said bearing segments are bonded to said packing layer.

15. The bearing according to claim 9 wherein said bearing is so configured that said compression axis is inclined inwardly and upwardly toward the riser axis when said bearing is supporting the riser on the rotary table.

16. The bearing according to claim 9 wherein said bearing is substantially circular in cross section, when viewed along said compression axis.

* * * * *